US009912088B2

(12) United States Patent
Chien et al.

(10) Patent No.: US 9,912,088 B2
(45) Date of Patent: Mar. 6, 2018

(54) MICRO PLUG CONNECTOR INCLUDING AN ANTI-BENDING PROTRUSION

(71) Applicant: Advanced-Connectek Inc., New Taipei (TW)

(72) Inventors: Ming-Lung Chien, New Taipei (TW); Ming-Yung Chang, New Taipei (TW); Yu-Bin Li, New Taipei (TW); Er-Li Huang, New Taipei (TW); Yao-Mei Wang, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/620,521

(22) Filed: Jun. 12, 2017

(65) Prior Publication Data

US 2017/0365946 A1 Dec. 21, 2017

(30) Foreign Application Priority Data

Jun. 15, 2016 (CN) ..... 2016 2 0571968 U

(51) Int. Cl.

| | |
|---|---|
| ***H01R 24/00*** | (2011.01) |
| ***H01R 33/00*** | (2006.01) |
| ***H01R 13/04*** | (2006.01) |
| ***H01R 13/405*** | (2006.01) |
| ***H01R 24/60*** | (2011.01) |
| *H01R 107/00* | (2006.01) |

(52) U.S. Cl.

CPC ..... *H01R 13/04* (2013.01); *H01R 13/405* (2013.01); *H01R 24/60* (2013.01); *H01R 2107/00* (2013.01)

(58) Field of Classification Search

CPC ..... H01R 23/02; H01R 24/60; H01R 24/62; H01R 24/64; H01R 13/648; H01R 13/6464; H01R 13/6466; H01R 13/6581

USPC ..... 439/660, 676, 607.01

See application file for complete search history.

(56) References Cited

U.S. PATENT DOCUMENTS

| | | | | |
|---|---|---|---|---|
| 7,534,141 | B1 * | 5/2009 | Wu | H01R 24/62 439/607.01 |
| 8,771,019 | B2 * | 7/2014 | Tai | H01R 13/41 439/492 |
| 2011/0124225 | A1 * | 5/2011 | Zhou | H01R 27/02 439/607.01 |

(Continued)

*Primary Examiner* — Hae Moon Hyeon

(74) *Attorney, Agent, or Firm* — Ming Chow; Sinorica, LLC

(57) ABSTRACT

A micro plug connector has an insulative housing with multiple mounting holes, multiple terminals respectively mounted in the mounting holes, and a shielding shell covering the insulative housing and the terminals. Each terminal has a mounting section mounted in the insulative housing, a welding section protruding backward from a rear end of the mounting section and protruding out of a rear portion of the insulative housing, and an electrical connection section protruding forward from a front end of the mounting section and partially exposed out of a corresponding one of the mounting holes. Each of at least one of the terminals has an anti-bending protrusion abutting against an inner top surface defined in the corresponding one of the mounting holes. The anti-bending protrusion prevents a distal end of the electrical connection section of the terminal from bending up and contacting the shielding shell by accident.

14 Claims, 9 Drawing Sheets

(56) References Cited

U.S. PATENT DOCUMENTS

2011/0183545 A1* 7/2011 Guo ..... H01R 12/724
439/607.01

* cited by examiner

MICRO PLUG CONNECTOR INCLUDING AN ANTI-BENDING PROTRUSION

BACKGROUND OF THE INVENTION

1. Field of the Invention

The present invention relates to a plug connector, and more particularly to a micro plug connector with terminals that do not be bent up to abut against a shielding shell, so as to prevent a short circuit.

2. Description of the Prior Art(s)

Universal serial bus (USB) connectors are widely used for connecting to other matching connectors among variety of electronic devices for data transmission or power supplying.

With reference to FIG. 9, because of characteristics of compactness and lightweight, conventional micro USB plug connectors 90 are extensively used on transmission cables or power cables. The conventional USB plug connector 90 comprises an insulative housing 91, multiple terminals 92, and a metallic shell 95. The terminals 92 are mounted through the insulative housing 91. Each terminal 92 has an electrical connection section 923. The electrical connection section 923 is defined at a front end of the terminal 92 and is exposed out from an upper surface of the insulative housing 91. The metallic shell 95 is hollow and covers the insulative housing 91 and the terminals 92.

When plugging the conventional micro USB plug connector 90 into a matching receptacle connector 80 on an electronic device, a user might obliquely inserts the conventional micro USB plug connector 90 by inadvertence, causing a rear half of the conventional micro USB plug connector 90 to be slightly curved relative to a front half of the conventional micro USB plug connector 90. Thus, the front ends of the terminals 92 are bent up to abut against the metallic shell 95. Consequently, a short circuit occurs.

To overcome the shortcomings, the present invention provides a micro plug connector to mitigate or obviate the aforementioned problems.

SUMMARY OF THE INVENTION

The main objective of the present invention is to provide a micro plug connector that can prevent a terminal from bending up and contacting a shielding shell, such that a short circuit is prevented accordingly.

The micro plug connector in accordance with the present invention has an insulative housing with multiple mounting holes, multiple terminals respectively mounted in the mounting holes, and a shielding shell covering the insulative housing and the terminals. Each terminal has a mounting section mounted in the insulative housing, a welding section protruding backward from a rear end of the mounting section and protruding out of a rear portion of the insulative housing, and an electrical connection section protruding forward from a front end of the mounting section and partially exposed out of a corresponding one of the mounting holes. Each of at least one of the terminals has an anti-bending protrusion abutting against an inner top surface defined in the corresponding one of the mounting holes.

With the anti-bending protrusion abutting against the inner top surface in the corresponding one of the mounting holes, the terminal does not bend up and does not contact the shielding shell by accident.

Other objectives, advantages and novel features of the invention will become more apparent from the following detailed description when taken in conjunction with the accompanying drawings.

DETAILED DESCRIPTION OF THE PREFERRED EMBODIMENTS

With reference to FIGS. 1 to 4, a first embodiment of a micro plug connector in accordance with the present invention comprises an insulative housing 10, multiple terminals 20, two hooking members 30, and a shielding shell 40.

Figure 7:
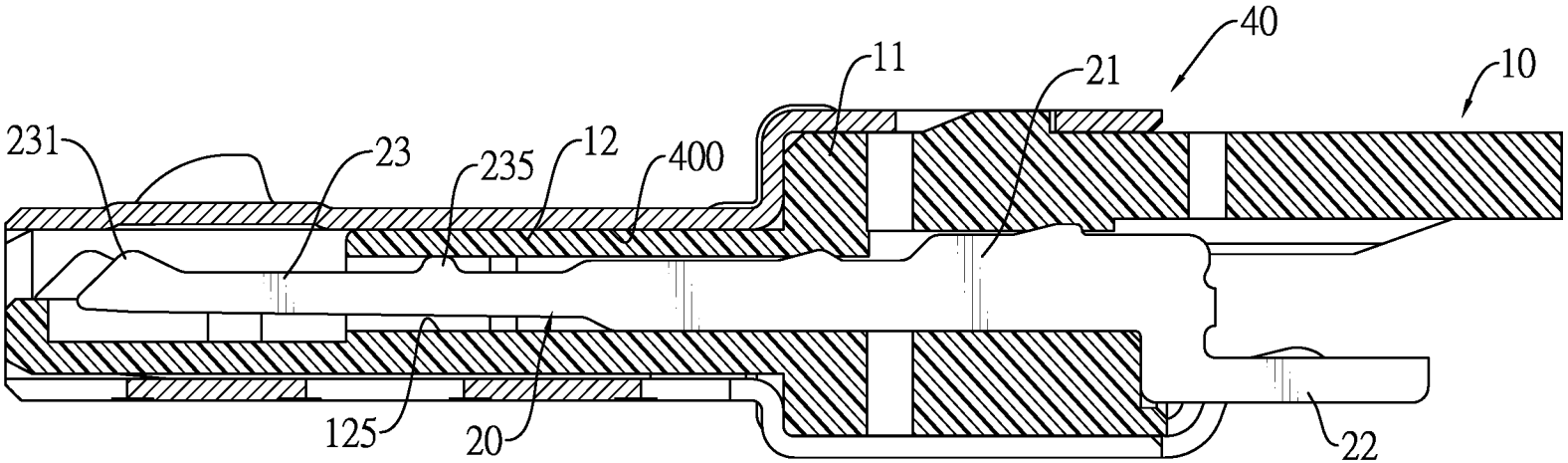
FIG. 7 is a cross-sectional side view of the micro plug connector in FIG. 1.

With further reference to FIG. 7, the insulative housing 10 has a base 11, a tongue 12, multiple mounting holes 125, and multiple inner top surfaces. The tongue 12 is formed on and protrudes forward from a front end of the base 11. The mounting holes 125 are defined through the base 11 and the tongue 12. The inner top surfaces are respectively defined in the mounting holes 125.

Figure 1:
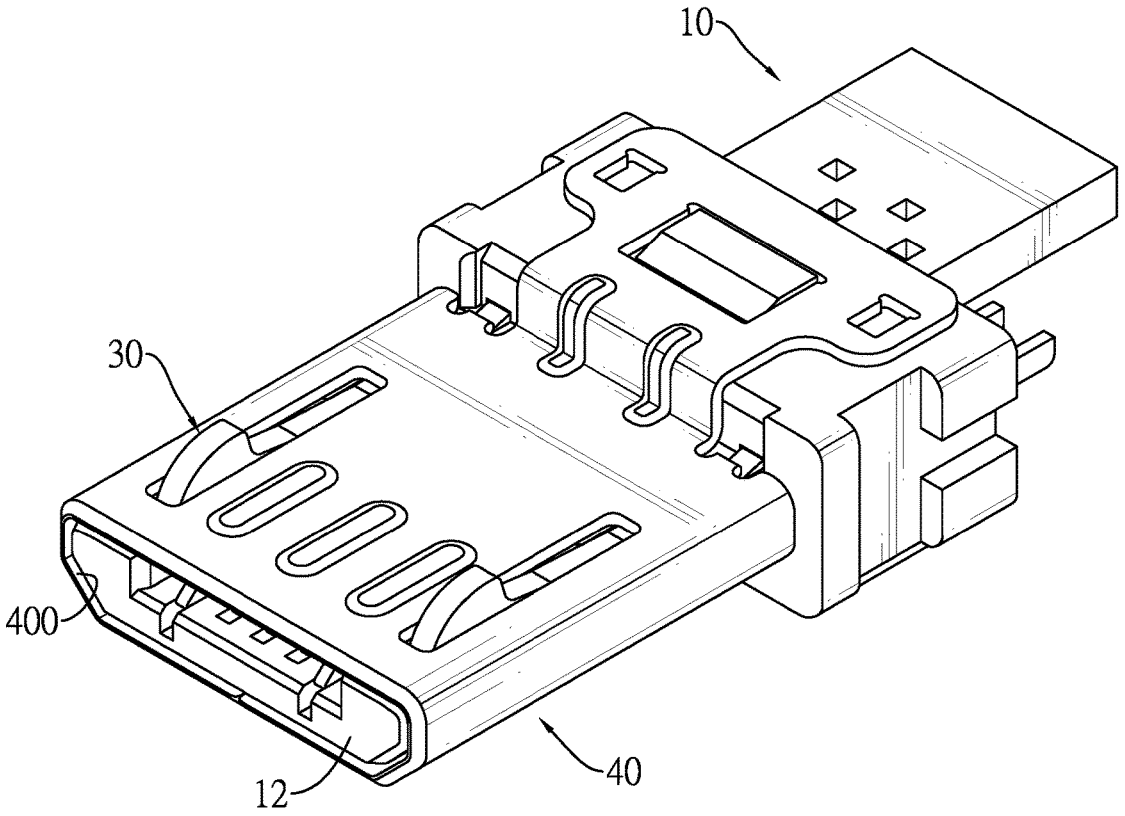
FIG. 1 is a perspective view of a first embodiment of a micro plug connector in accordance with the present invention.
Figure 2:
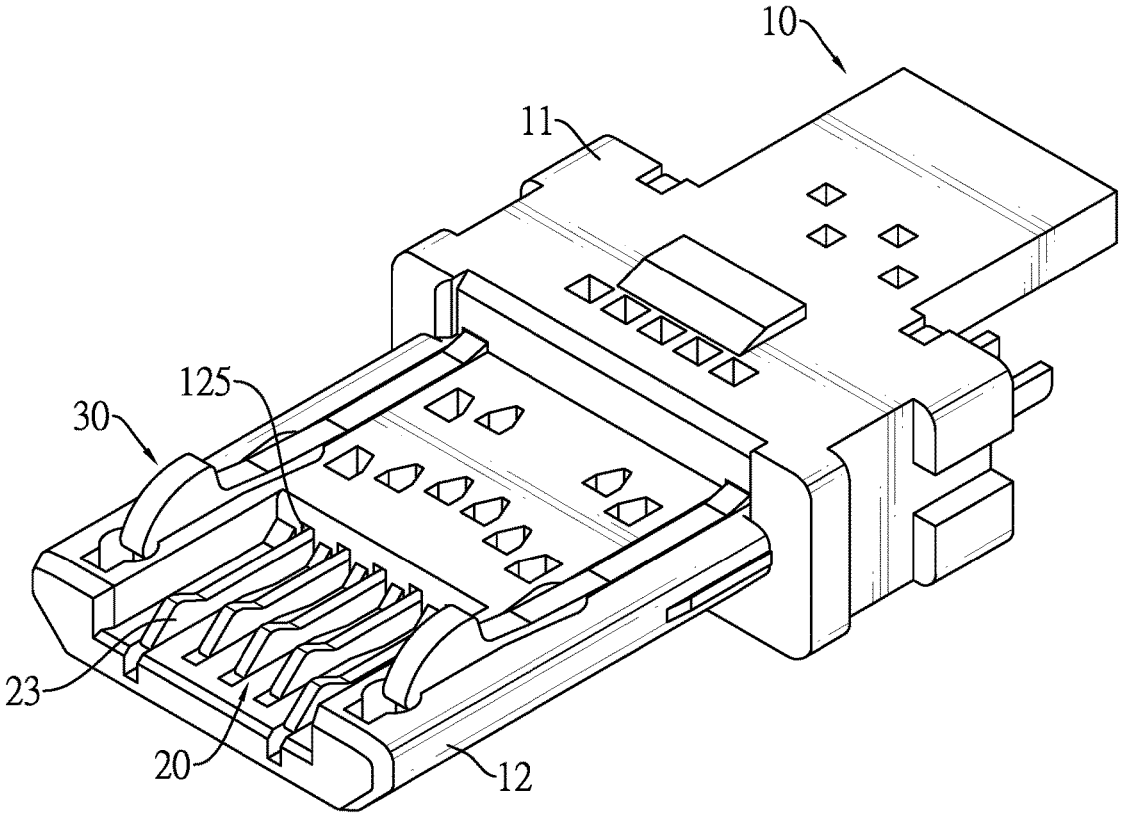
FIG. 2 is a perspective view of the micro plug connector in FIG. 1, showing that an outer shell is omitted.
Figure 3:
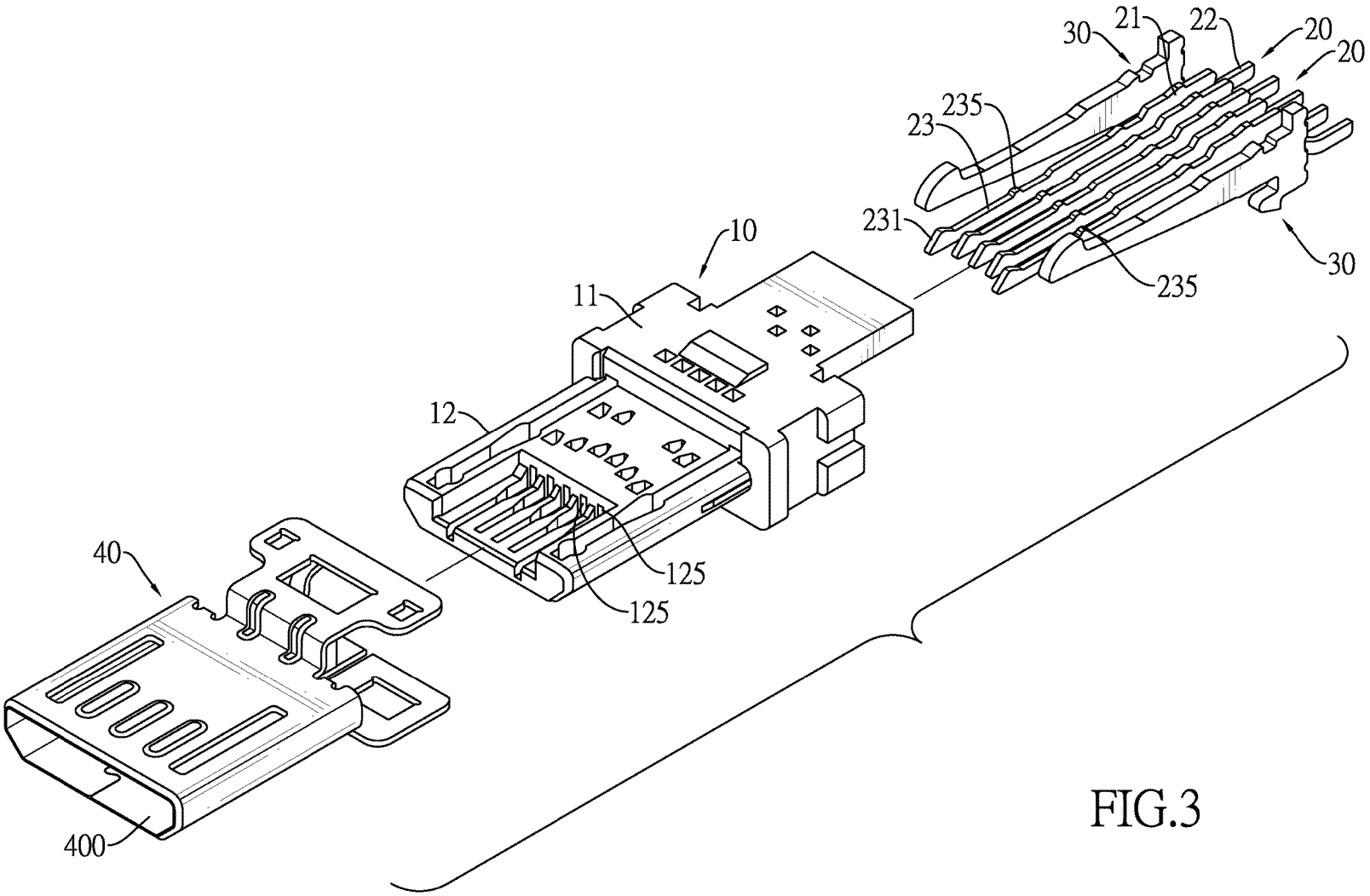
FIG. 3 is an exploded perspective view of the micro plug connector in FIG. 1.
Figure 4:
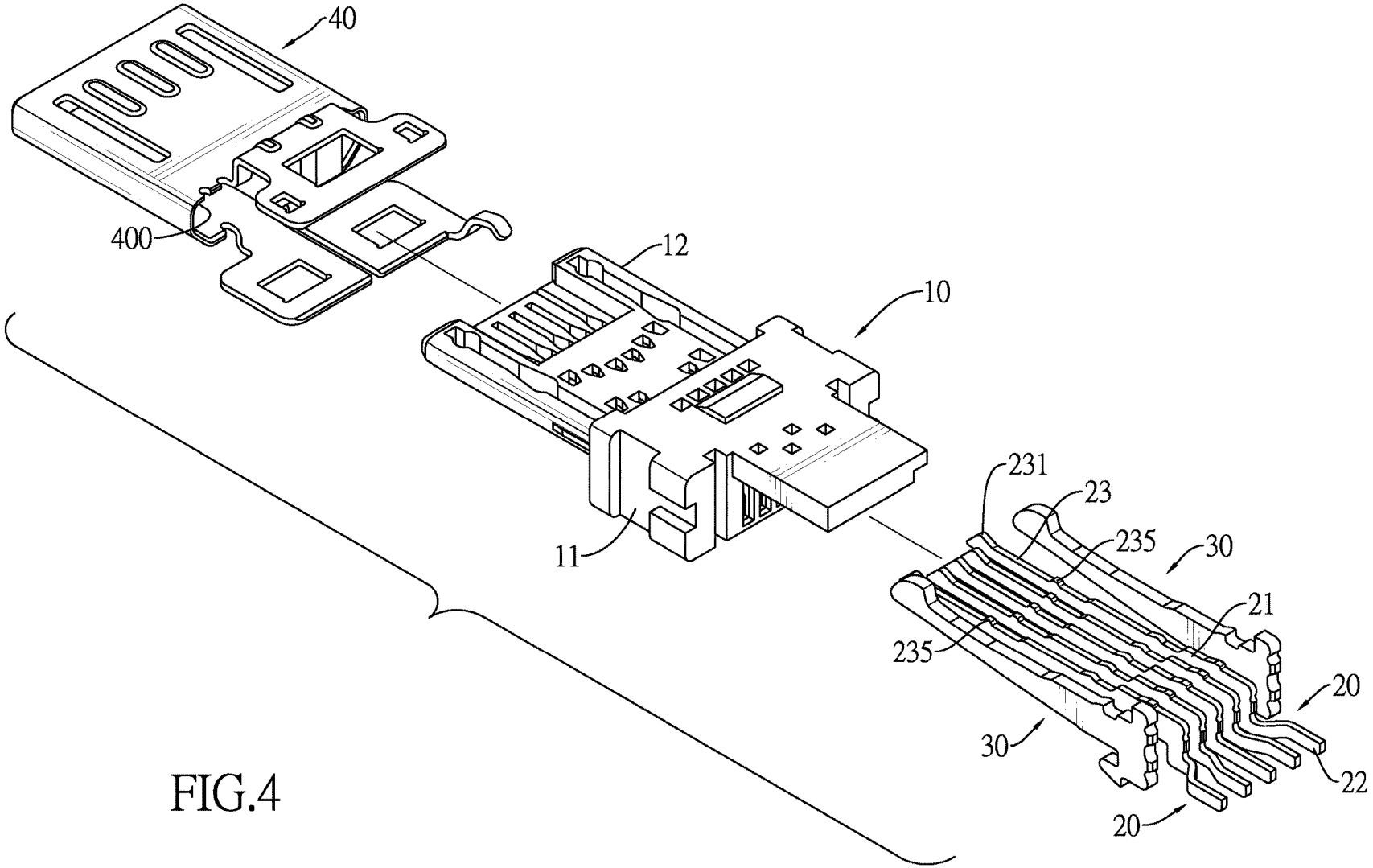
FIG. 4 is another exploded perspective view of the micro plug connector in FIG. 1.
Figure 5:
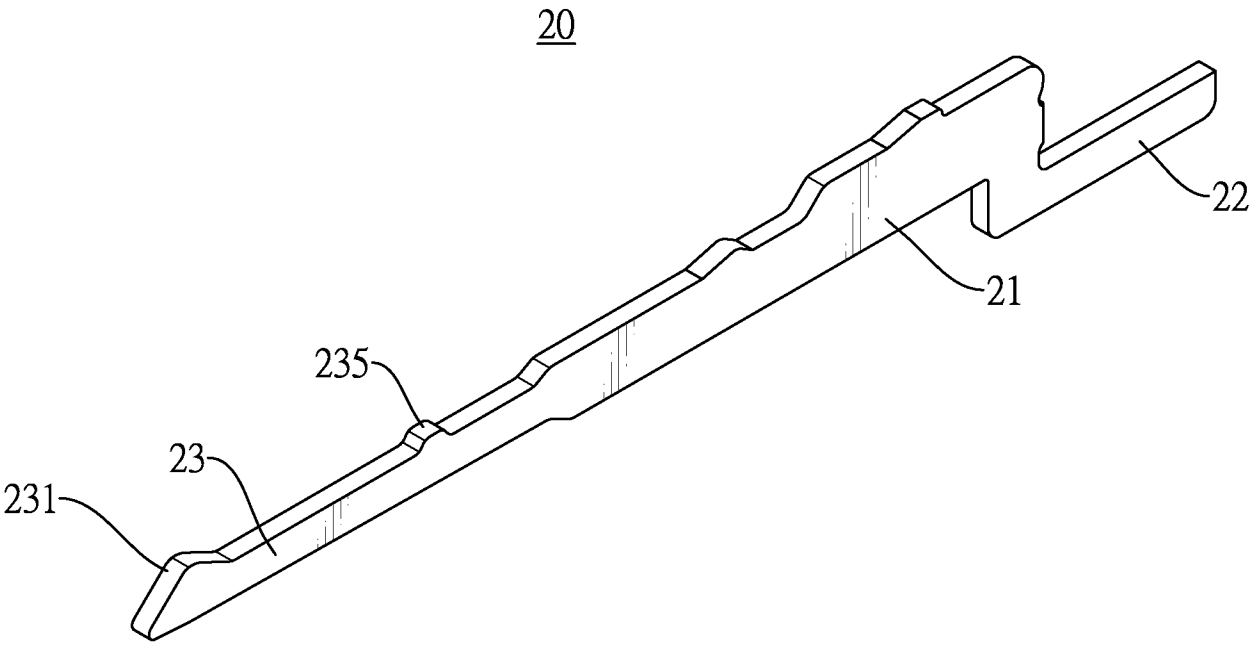
FIG. 5 is a perspective view of a terminal of the micro plug connector in FIG. 1.
Figure 6:
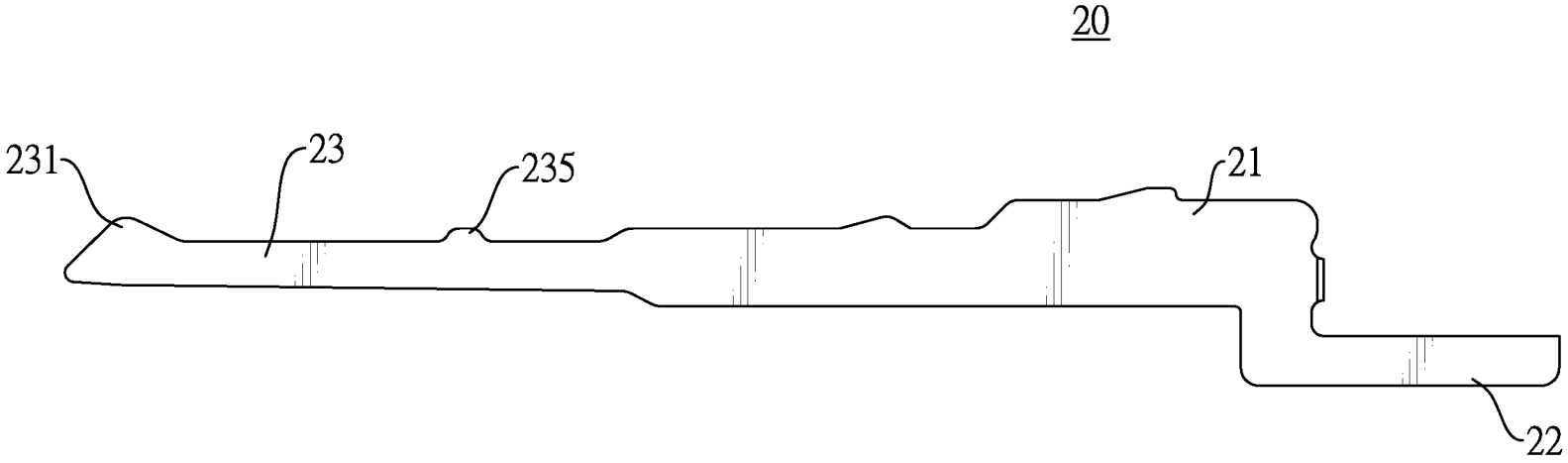
FIG. 6 is a side view of the terminal in FIG. 5.

With further reference to FIGS. 5 and 6, the terminals 20 are respectively mounted in the mounting holes 125 of the insulative housing 10. Each terminal 20 has a mounting section 21, a welding section 22, an electrical connection section 23, an electrical connection protrusion 231, and an anti-bending protrusion 235.

The mounting section 21 is mounted in the base 11. The welding section 22 is formed on and protrudes backward from a rear end of the mounting section 21 and protrudes out of a rear portion of the insulative housing 10. The electrical connection section 23 is formed on and protrudes forward from a front end of the mounting section 21, is mounted on the tongue 12, and is partially exposed out of a corresponding one of the mounting holes 125. The electrical connection section 23 has a distal end and an upper edge. Preferably, a thickness of the electrical connection section 23 of each terminal 20 is thinner than a thickness of the mounting section 21 of the terminal 20.

The electrical connection protrusion 231 is formed on and protrudes from the distal end of the electrical connection section 23, and selectively contacts a corresponding one of terminals of a matching micro receptacle connector.

The anti-bending protrusion 235 is formed on and protrudes from the upper edge of the electrical connection section 23 and abuts against the inner top surface in the corresponding one of the mounting holes 125. A position of the anti-bending protrusion 235 relative to the distal end of the electrical connection section 23 may be adjusted according to design requirements. For instance, if a more powerful anti-bending effect is needed, the anti-bending protrusion 235 should be disposed closer to the distal end of the electrical connection section 23. Since the anti-bending protrusion 235 is used as a fulcrum, the more closely the anti-bending protrusion 235 is disposed next to the distal end of the electrical connection section 23, the shorter an arm defined between the anti-bending protrusion 235 and the distal end of the electrical connection section 23 and the harder the distal end of the electrical connection section 23 to be bent.

The hooking members 30 are mounted on a front portion of the insulative housing 10. Each hooking member 30 has a hook formed on a front end of the hooking member 30.

The shielding shell 40 is made of metal, covers the insulative housing 10 and the terminals 20, and has a cavity 400. The cavity 400 is defined in the shielding shell 40 and receives the insulative housing 10 and the terminals 20. The hooks of the hooking members 30 protrude out of an upper surface of the shielding shell 40.

With the anti-bending protrusion 235 of each terminal 20 being used as the fulcrum and abutting against the inner top surface in the corresponding one of the mounting holes 125, the distal end of the electrical connection section 23 is prevented from bending up and contacting the shielding shell 40 by accident. Accordingly, a short circuit that occurs when part of or all of the terminals 20 contact the metal shielding shell 40 can be also prevented.

Figure 8:
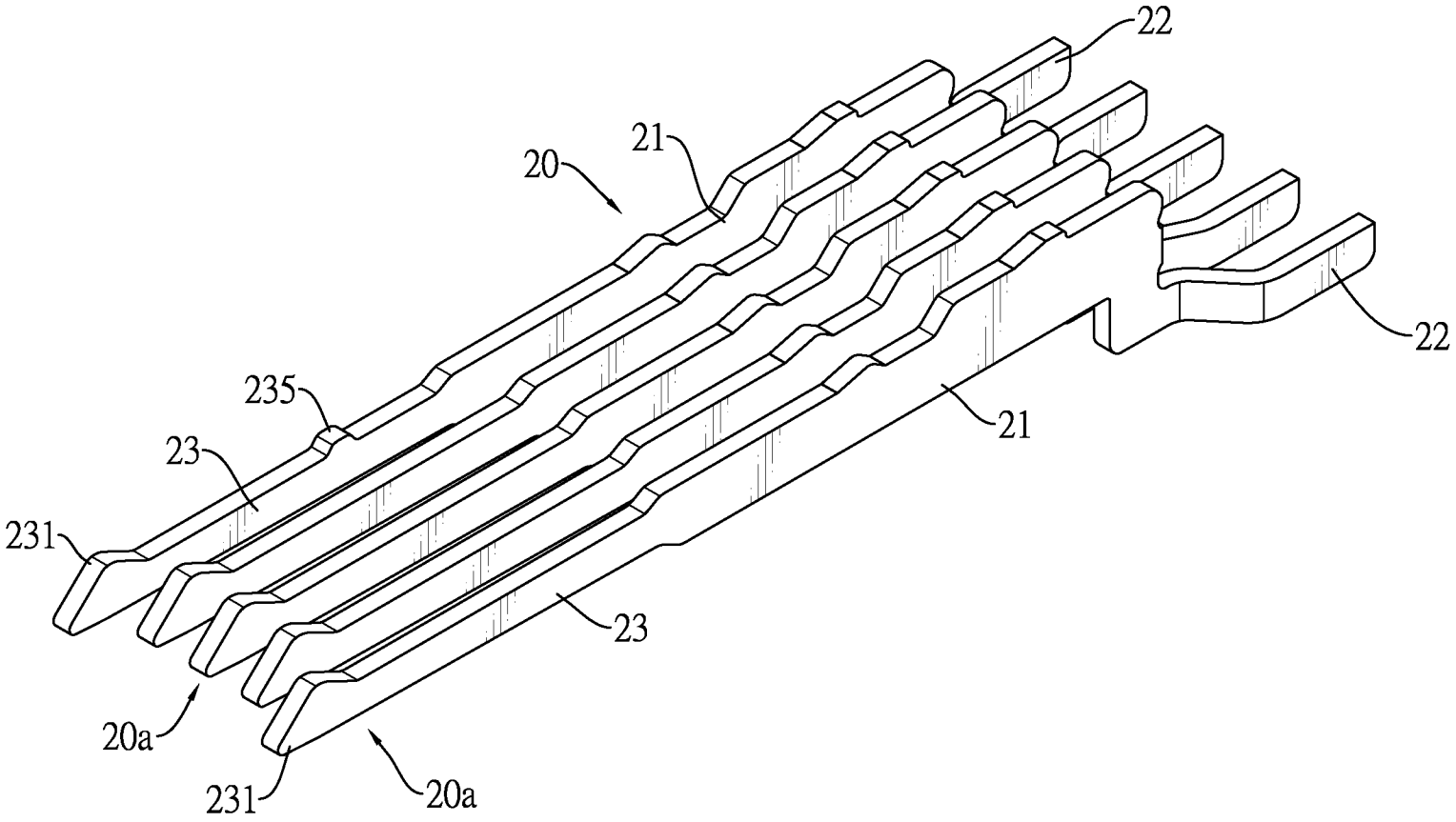
FIG. 8 is a perspective view of a second embodiment of a micro plug connector in accordance with the present invention.
Figure 9:
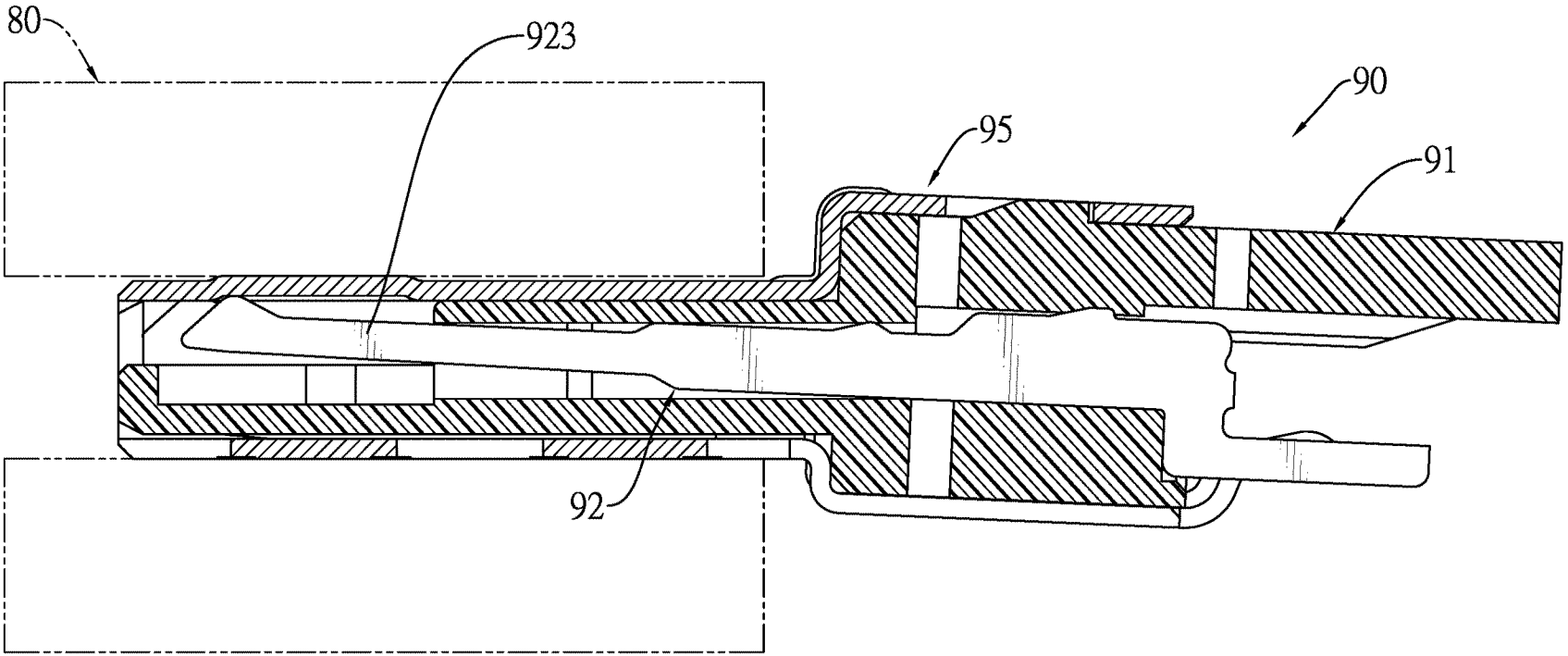
FIG.9 PRIOR ART
FIG. 9 is an operational cross-sectional side view of a conventional micro plug connector in accordance with the prior art.

With further reference to FIG. 8, in a second embodiment of a micro plug connector in accordance with the present invention, one of the terminals 20 has the anti-bending protrusion 235 while the other terminals 20 are free from having the anti-bending protrusion 235. The terminal 20 with the anti-bending protrusion 235 may be a power supply terminal.

The micro plug connector as described is a short circuit prevention micro plug connector. The anti-bending protrusion 235 of each terminal 20 abuts against the inner top surface in the corresponding one of the mounting holes 125, such that the distal end of the electrical connection section 23 is prevented from bending up and contacting the shielding shell 40. Accordingly, the short circuit can be prevented. When a user obliquely inserts the micro plug connector into a match receptacle connector by inadvertence, even though a rear half of the micro plug connector is slightly curved relative to a front half of the micro plug connector, the anti-bending protrusion 235 that abuts against the inner top surface in the corresponding one of the mounting holes 125 can prevent the distal end of the electrical connection section 23 from bending up and contacting the shielding shell 40 by accident.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A micro plug connector comprising:

an insulative housing having a base;

a tongue formed on and protruding forward from a front end of the base;

multiple mounting holes defined through the base and the tongue; and multiple inner top surfaces respectively defined in the mounting holes;

multiple terminals respectively mounted in the mounting holes of the insulative housing and each terminal having a mounting section mounted in the base;

a welding section formed on and protruding backward from a rear end of the mounting section and protruding out of a rear portion of the insulative housing; and an electrical connection section formed on and protruding forward from a front end of the mounting section, mounted on the tongue, and partially exposed out of a corresponding one of the mounting holes, and the electrical connection section having an upper edge;

wherein each of at least one of the terminals has an anti-bending protrusion, and the anti-bending protrusion is formed on and protrudes from the upper edge of the electrical connection section of the terminal and abuts against the inner top surface in the corresponding one of the mounting holes; and a shielding shell having a cavity defined in the shielding shell and receiving the insulative housing and the terminals.

2. The micro plug connector as claimed in claim 1, wherein each of the terminals has the anti-bending protrusion.

3. The micro plug connector as claimed in claim 1, wherein one of the terminals has the anti-bending protrusion.

4. The micro plug connector as claimed in claim 3, wherein the terminal with the anti-bending protrusion is a power supply terminal.

5. The micro plug connector as claimed in claim 1, wherein the micro plug connector is a short circuit prevention micro plug connector.

6. The micro plug connector as claimed in claim 1, wherein the anti-bending protrusion of each of the at least one of the terminals is a fulcrum and prevents a distal end of the electrical connection section of the terminal from bending up and contacting the shielding shell by accident.

7. The micro plug connector as claimed in claim 1, wherein a thickness of the electrical connection section of each terminal is thinner than a thickness of the mounting section of the terminal.

8. The micro plug connector as claimed in claim 2, wherein a thickness of the electrical connection section of each terminal is thinner than a thickness of the mounting section of the terminal.

9. The micro plug connector as claimed in claim 3, wherein a thickness of the electrical connection section of each terminal is thinner than a thickness of the mounting section of the terminal.

10. The micro plug connector as claimed in claim 4, wherein a thickness of the electrical connection section of each terminal is thinner than a thickness of the mounting section of the terminal.

11. The micro plug connector as claimed in claim 1, wherein the micro plug connector further comprises two hooking members, the hooking members are mounted on a front portion of the insulative housing, each hooking member has a hook formed on a front end of the hooking member and protrudes out of an upper surface of the shielding shell.

12. The micro plug connector as claimed in claim 2, wherein the micro plug connector further comprises two hooking members, the hooking members are mounted on a front portion of the insulative housing, each hooking member has a hook formed on a front end of the hooking member and protrudes out of an upper surface of the shielding shell.

13. The micro plug connector as claimed in claim 3, wherein the micro plug connector further comprises two hooking members, the hooking members are mounted on a front portion of the insulative housing, each hooking member has a hook formed on a front end of the hooking member and protrudes out of an upper surface of the shielding shell.

14. The micro plug connector as claimed in claim 4, wherein the micro plug connector further comprises two hooking members, the hooking members are mounted on a front portion of the insulative housing, each hooking member has a hook formed on a front end of the hooking member and protrudes out of an upper surface of the shielding shell.

* * * * *